United States Patent [19]

Sefried, II

[11] 4,206,560

[45] Jun. 10, 1980

[54] LONG STROKE EJECTOR FOR A REVOLVER

[75] Inventor: Harry H. Sefried, II, New Haven, Conn.

[73] Assignee: Sturm, Ruger & Co., Inc., Southport, Conn.

[21] Appl. No.: 960,615

[22] Filed: Nov. 14, 1978

[51] Int. Cl.[2] ..... F41C 1/00

[52] U.S. Cl. ..... 42/68

[58] Field of Search ..... 42/68, 62, 59

[56] References Cited

U.S. PATENT DOCUMENTS

| | | | |
|---|---|---|---|
| 1,181,417 | 5/1916 | Wesson | 42/68 |
| 3,628,278 | 12/1971 | Ruger | 42/62 |
| 3,633,302 | 1/1972 | Lewis | 42/68 |
| 3,685,193 | 8/1972 | Sefried | 42/62 |
| 3,874,104 | 4/1975 | Sibley | 42/68 |

*Primary Examiner*—Charles T. Jordan
*Attorney, Agent, or Firm*—Pennie & Edmonds

[57] ABSTRACT

A revolver of the swing-out cylinder type is provided with an improved ejector means the longitudinal travel or stroke of which is appreciably greater than that of conventional ejector means. The ejector means has a cartridge ejector portion for engaging the rims of cartridges contained in the chambers of the cylinder of the revolver and a generally tubular ejector guide portion slidably mounted on the rearward end of the cylinder and extending forwardly into the longitudinal center bore of the cylinder pivot shaft. The ejector spring that urges the ejector means to its normal forwardmost position has an outer ejector spring section disposed within the annular space between the tubular guide portion of the ejector means and the center bore of the cylinder pivot shaft and an inner ejector spring section of smaller diameter than the outer ejector spring section disposed on the rearward end of the ejector rod. An ejector spring connector means connects the forward end of the outer ejector spring section to the rearward end of the inner ejector spring section. The inner ejector spring section is disposed generally forwardly of the outer ejector spring section when the ejector means is at its forwardmost position and is disposed in telescopic fashion within the forward end of the outer ejector spring section when the ejector means is at its rearwardmost cartridge ejecting position.

6 Claims, 9 Drawing Figures

LONG STROKE EJECTOR FOR A REVOLVER

TECHNICAL FIELD

The present invention relates to ejectors for revolvers and comprises an improvement in such ejectors by means of which the stroke or longitudinal travel of the ejector is substantially increased.

BACKGROUND ART

Conventional revolvers of the type to which the present invention relates have a frame on which the barrel, the cylinder, the hammer, the trigger and the other parts of the mechanism of the revolver are mounted. The cylinder is formed with a plurality of cartridge receiving chambers and is rotatably mounted on the frame in an opening formed in the frame so that when it is rotated about its longitudinal axis each of the cartridge receiving chambers is successively brought into axial alignment with the longitudinal axis of the barrel of the revolver. To facilitate loading and unloading of the chambers of the cylinder, the revolver is advantageously provided with a cylinder crane the lower end of which is pivotally mounted on the frame below the barrel, the cylinder crane having a rearwardly extending cylinder pivot shaft on which the cylinder is rotatably mounted. The pivot cylinder crane permits the cylinder to be swung or rotated sideways from its firing position within the frame to its loading and unloading position outside of the frame, the cylinder being held at its firing position by a manually operated cylinder latch.

When the cylinder latch is manually released the cylinder can be rotated to its loading and unloading position outside the frame of the revolver. When at this position unfired cartridges may easily be inserted into and be removed from the chambers of the cylinder. However, the cases of fired cartridges are not so easily removed from the chambers of the cylinder, and ejector means are advantageously provided to effect the ejection of these cartridge cases. The ejector means is normally mounted for longitudinal movement along the longitudinal axis of the cylinder and advantageously is disposed in a longitudinal center bore formed in the cylinder and in the cylinder pivot shaft. The ejector means advantageously comprises a star-shaped cartridge ejector portion and a generally tubular ejector guide portion, the cartridge ejector portion being adapted to engage the rims of the cartridges contained in the chambers of the cylinder and the ejector guide portion being slidably mounted for longitudinal movement on the rearward end of the cylinder and extending forwardly into the longitudinal center bore of the cylinder pivot shaft on which the cylinder is rotatably mounted. An ejector push rod is threadably connected to the forward end of the tubular guide portion of the ejector means, the ejector push rod extending forwardly through an opening formed in the cylinder crane and being slidably mounted for longitudinal movement on the cylinder crane. A helically wound ejector spring is disposed within the longitudinally extending annular space defined by the outer surface of the tubular guide portion of the ejector means and the inner surface of the longitudinal center bore of the cylinder pivot shaft, the ejector spring urging the ejector means and the ejector rod to their forwardmost position. When the ejector push rod and ejector means are at their forwardmost position rimmed cartridges may be fully inserted in each of the chambers of the cylinder. When the ejector push rod and ejector means are moved to their rearwardmost position the star-shaped cartridge ejector portion of the ejector means pushes the cartridge cases rearwardly to facilitate removal of the cartridges from the chambers of the cylinder. Revolvers having ejector means of the general type described herein are shown in U.S. Pat. No. 3,628,278 to William B. Ruger and U.S. Pat. No. 3,685,193 to Harry H. Sefried, II.

In many revolvers of conventional design the longitudinal travel or stroke of the ejector means is insufficient to completely withdraw the forward ends of the cartridge cases from the chambers of the cylinder, and if these cartridge cases do not fall free from the cylinder when the revolver is up-ended the removal of the cases from the chambers must be completed manually by the shooter. The hang up of the forward ends of the fired cartridges in the cylinder is objectionable, especially in military arms employed under combat conditions. As the longitudinal travel or stroke of the ejector means is largely determined by the length of the cylinder, and as this, in turn, is largely dependent on the size or caliber of the cartridge that the revolver is designed to fire, there appears to be little that can be done to increase the stroke of the ejector means short of increasing the length of the cylinder with consequent redesigning and redimensioning of the entire revolver. After an intensive investigation into the solution of this problem, I have now devised a novel arrangement for the ejector spring which provides a substantial increase in the length of the stroke of the ejector means without increasing the length of the cylinder or effecting any other change in the mechanism of the revolver.

DISCLOSURE OF INVENTION

The improved ejector means of the invention is applicable to revolvers having a frame, a cylinder crane pivotally mounted on the frame, a cylinder rotatably mounted on the cylinder pivot shaft of the cylinder crane, and ejector means slidably mounted in the longitudinal center bore of the cylinder pivot shaft for ejecting cartridges contained in the cartridge receiving chambers of the cylinder. The ejector means has a cartridge ejector portion adapted to engage the rims of cartridge cases contained in the chambers of the cylinder and a generally tubular ejector guide portion slidably mounted for longitudinal movement on the rearward end of the cylinder and extending forwardly into the longitudinal center bore of the cylinder pivot shaft. An ejector push rod is connected to the forward end of the tubular guide portion of the ejector means, the ejector rod being slidably mounted for longitudinal movement on the cylinder crane. A helically wound ejector spring is disposed within the longitudinally extending annular space defined by the outer surface of the guide portion of the ejector means and the inner surface of the longitudinal center bore of the cylinder pivot shaft, the ejector spring urging the ejector means and ejector rod to their forwardmost position.

The stroke of the ejector means is increased in accordance with the invention by providing the ejector means with a telescoping ejector spring having an outer ejector spring section, an inner ejector spring section the outside diameter of which is less than the inside diameter of the outer spring section, and ejector spring connector means connecting the forward end of the outer spring section to the rearward end of the inner spring section. The outer ejector spring section is disposed within the annular space defined by the outer surface of the tubular guide portion of the ejector means and the inner surface of the center bore of the cylinder pivot shaft of the cylinder crane, and the inner ejector spring section is disposed on the ejector rod generally forward of the outer ejector spring section when the ejector means is at its forwardmost position and is disposed within the forward end of the outer ejector spring section when the ejector means is at its rearwardmost position.

In one advantageous embodiment of the invention the ejector spring connector means comprises an annular sleeve having an outwardly extending flange at its forward end and an inwardly extending flange at its rearward end. The forward end of the outer ejector spring section abuts against the forward flange of the ejector spring sleeve and the rearward end of the inner ejector spring abuts against the rearward flange of the ejector spring sleeve. The outside diameter of the annular wall of the ejector spring sleeve is less than the inside diameter of the outer ejector spring section and the inside diameter of said sleeve is more than the outside diameter of the inner ejector spring section so that the sleeve and the inner ejector spring section are received within the forward end of the outer ejector spring section when the ejector means is at its rearwardmost position.

In another advantageous embodiment of the invention the outer ejector spring section and the inner ejector spring section are formed from a continuous length of helically wound wire, the ejector spring connector means comprising at least one inwardly spiraling turn of the continuous ejector spring. The inwardly spiraling turn of the helically wound ejector spring is located at and connects the forward end of the outer ejector spring section and the rearward end of the inner ejector spring section. When the ejector means is moved from its forwardmost to its rearwardmost position the inwardly spiraling turn of the ejector spring moves from in front of the outer spring section to beneath this spring section.

BRIEF DESCRIPTION OF THE DRAWINGS

The long stroke ejector means of the invention will be better understood from the following description in conjunction with the accompanying drawings of which.

DETAILED DESCRIPTION

Figure 1:
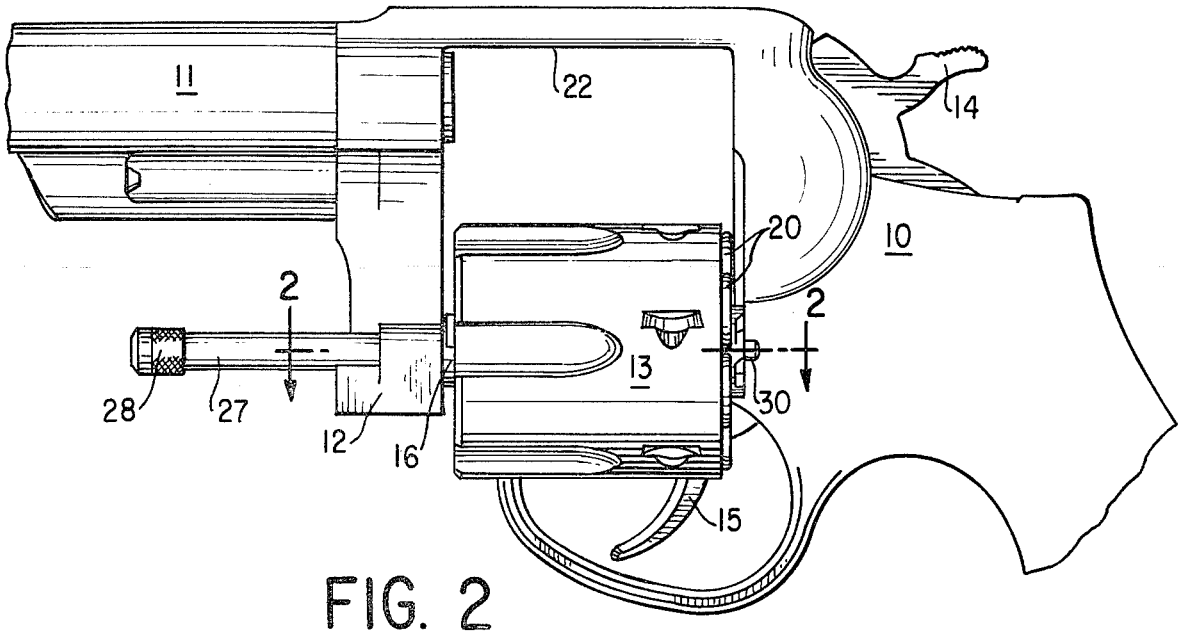
FIG. 1 is a side elevation of a revolver employing the long stroke ejector of the invention showing the cylinder and cylinder crane at their cartridge loading and unloading position.

The long stroke ejector of the invention is designed to be used with revolvers of the swing-out cylinder type in which the cylinder is rotatably mounted on a pivoted cylinder crane. As shown best in FIG. 1, the principal externally visible components of a revolver of this type include the frame 10, barrel 11 secured to the frame, a cylinder crane 12 pivotally mounted on the frame, a cylinder 13 rotatably mounted on the cylinder crane, a hammer 14 and a trigger 15. As shown best in FIGS. 2, 3, 4 and 5, the cylinder crane 12 has a rearwardly extending cylinder pivot shaft 16 that is formed with a longitudinal center bore 17, and the cylinder 13 is formed with a longitudinal center bore 18 adapted to receive the cylinder pivot shaft 16 of the cylinder crane 12 and also with a plurality of cartridge chambers 19 each adapted to receive a cartridge or cartridge case 20. When the cylinder 13 and cylinder crane 12 are at their closed and ready-to-fire position (not shown), the cylinder 13 is received in the opening 22 formed in the frame 10 with the uppermost chamber 19 of the cylinder directly in line with the bore of the barrel 11 of the revolver. When the cylinder 13 and cylinder crane 12 are swung out to their loading and unloading position as shown in FIG. 1, the cylinder 13 is outside of the frame 10 so that cartridges can be inserted into each of the chambers 19 and fired cartridge cases can be withdrawn therefrom in the manner known in the art. To facilitate the removal of the cases of fired cartridges from the chambers 19 of the cylinder 13, longitudinally movable ejector means is disposed in the longitudinal center bore 18 and 17 of the cylinder 13 and cylinder pivot shaft 16, respectively. The ejector means has a vertically disposed star-shaped cartridge ejector portion 24 and a longitudinally disposed generally tubular ejector guide portion 25. The cartridge ejector portion 24 is normally positioned in a recess 26 formed in the rearward surface of the cylinder 13 and is adapted to engage the rims of the cartridges 20 contained within the chambers 19 of the cylinder. The ejector guide portion 25 is slidably mounted on the cylinder 13 at the rearward end of the longitudinal center bore 18 of the cylinder and extends forwardly into the longitudinal center bore 17 of the cylinder pivot shaft 16. An ejector push rod 27 is threadably connected to the forward end of the tubular guide portion 25 of the ejector means and is slidably mounted on the cylinder crane 12 for longitudinal movement within the center bore 17 thereof. The ejector push rod 27 extends forwardly an appreciable distance beyond the cylinder crane 12 and is provided with a knurlled knob 28 on tbe forward end thereof. A helically wound ejector spring is located in the annular space defined by the outer surface of the tubular guide portion 25 of the ejector means and the inner surface of the longitudinal center bore 17 of the cylinder pivot shaft 16, the ejector spring urging the ejector means and the ejector rod to their forwardmost positions. In addition, a crane latch plunger 30, a latch spring 31 and latch center pin 32 are disposed within the center bore 33 of the ejector means and the ejector push rod in the manner known in the art.

Figure 2:
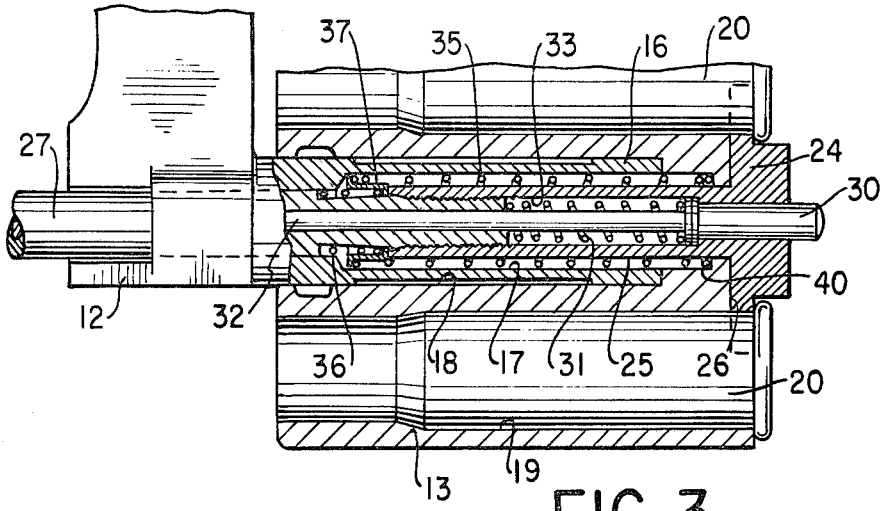
FIG. 2 is an enlarged sectional view along line 2—2 of FIG. 1 showing one advantageous embodiment of the long stroke ejector of the invention with the ejector at its forwardmost position.
Figure 3:
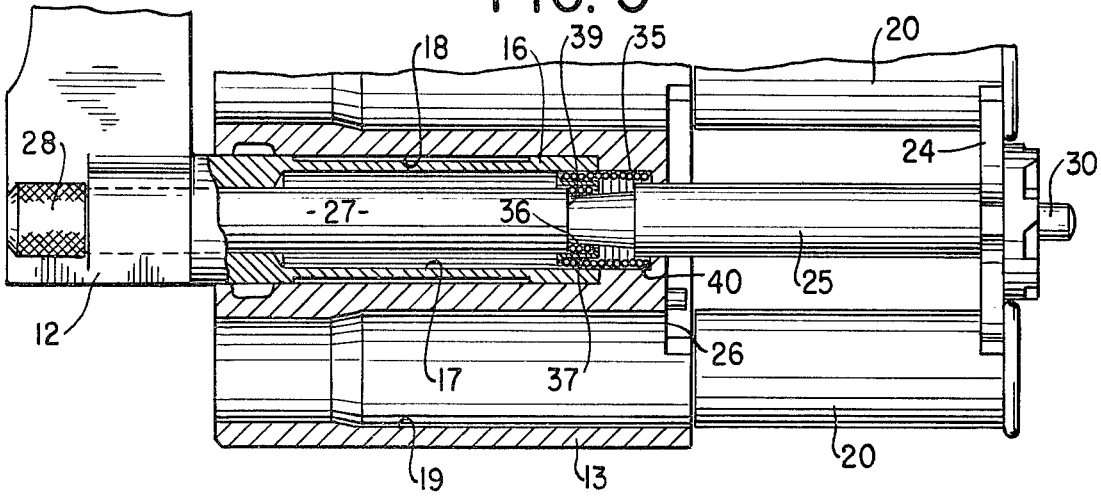
FIG. 3 is a sectional view of the long stroke ejector of FIG. 2 showing the ejector at its rearwardmost position.
Figure 4:
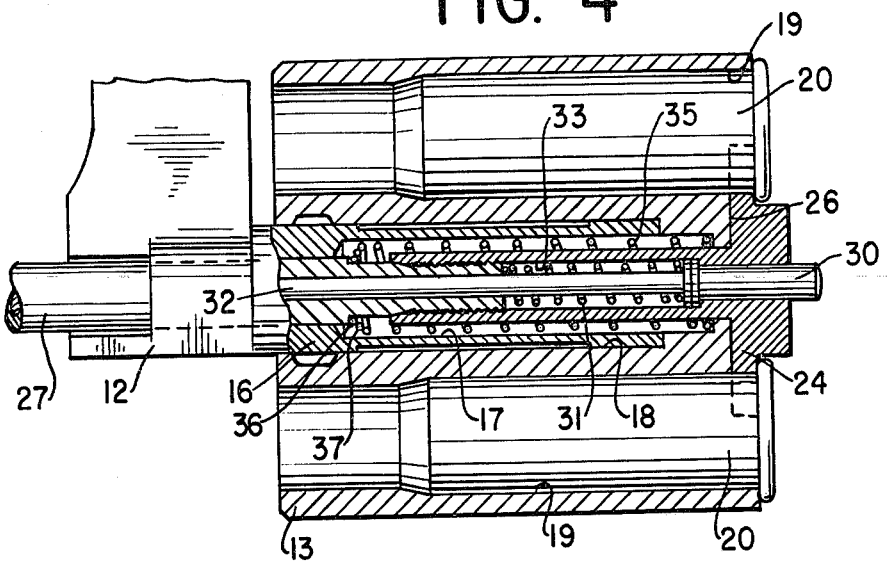
FIG. 4 is an enlarged sectional view along line 2—2 of FIG. 1 showing another advantageous embodiment of the long stroke ejector of the invention with the ejector at its forwardmost position.
Figure 5:
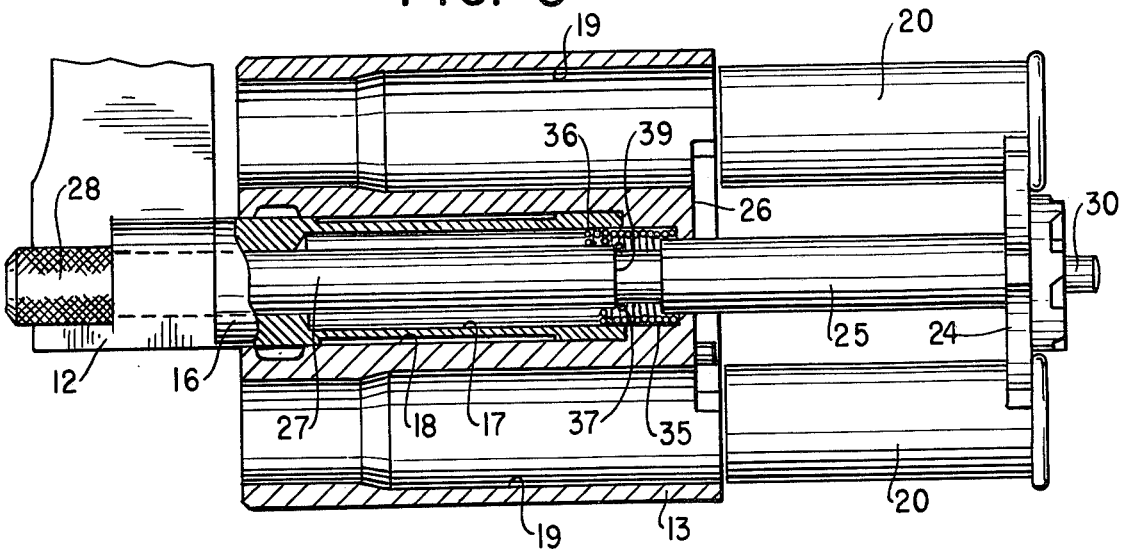
FIG. 5 is a sectional view of the long stroke ejector of FIG. 4 showing the ejector means at its rearwardmost position.
Figure 6:
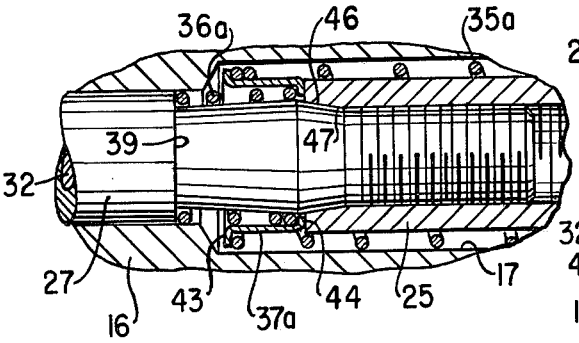
FIG. 6 is an enlarged fragmentary sectional view of the ejector spring connector means of the ejector shown in FIG. 2.
Figure 7:
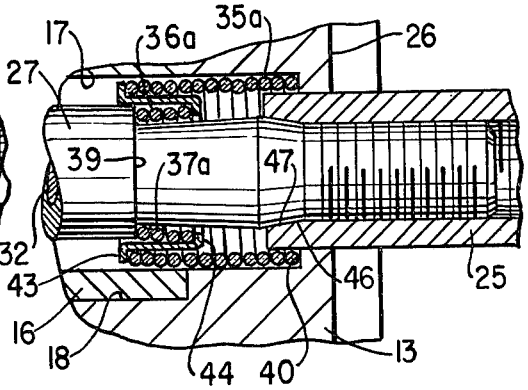
FIG. 7 is an enlarged fragmentary sectional view of the ejector spring connector means of the ejector shown in FIG. 3.
Figure 8:
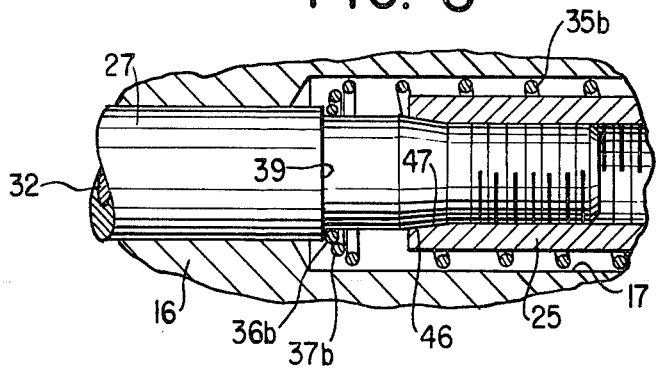
FIG. 8 is an enlarged fragmentary sectional view of the ejector spring connector means of the ejector shown in FIG. 4.
Figure 9:
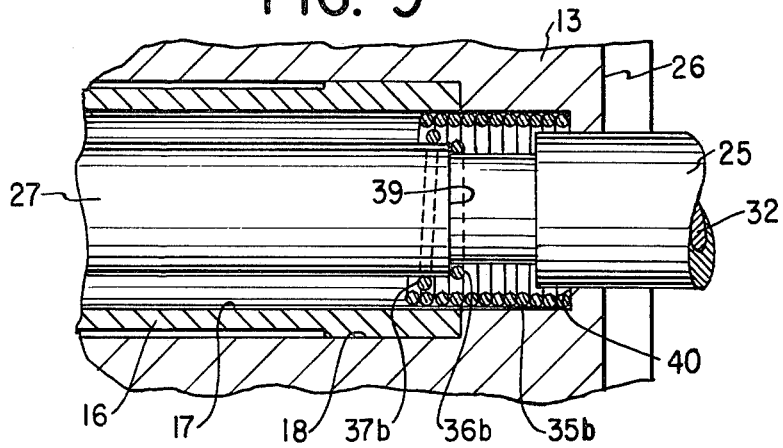
FIG. 9 is an enlarged fragmentary sectional view of the ejector spring connector means of the ejector shown in FIG. 5.

When the ejector means is at its forwardmost position as shown in FIGS. 2 and 4, the cartridge cases 20 are fully received in the chambers 19 of the cylinder 13. When the ejector means is moved to its rearwardmost position by pressure on the knob 28 of the ejector push rod 27, the cartridge ejector portion 24 of the ejector means should move the cartridge cases 20 rearwardly out of the chambers 19 of the cylinder as shown in FIGS. 3 and 5. However, the longitudinal travel or stroke of the ejector means is limited by the longitudinal space available within the center bore 18 of the cylinder 13, and in many prior revolvers of conventional design the stroke of the ejector means is insufficient to completely withdraw the forward ends of the cartridge cases 20 from the chambers 19 of the cylinder. That is to say, when the ejector means of a revolver of conventional design is moved rearwardly to eject the cartridge cases 26 from the cylinder 13, the ejector spring is compressed until all of the coils of the spring are tightly pressed together at which point further rearward movement of the ejector means is blocked by the tightly packed coils of the spring. If the longitudinal space available within the center bore 18 of the cylinder 13 is insufficient to permit full rearward movement of the ejector means before being blocked by the tightly packed coils of the ejector spring, the forward ends of the cartridge cases 20 will not be completely withdrawn from the chambers 19 of the cylinder 13.

In accordance with the present invention the stroke of the ejector means is increased by providing the ejector means with a telescoping ejector spring arrangement having inner and outer ejector spring sections, the inner ejector spring section being disposed generally forwardly of the outer ejector spring section when the ejector means is at its normal forwardmost position and being disposed in telescopic fashion within the outer ejector spring section when the ejector means is moved to its rearwardmost cartridge ejecting position. More specifically, as shown in FIGS. 2–9 of the drawings the ejector spring comprises a helically wound outer ejector spring section 35 disposed within the annular space defined by the outer surface of the tubular guide portion 25 of the ejector means and the inner surface of the center bore 17 of the cylinder pivot shaft 16 of the cylinder crane 12, an inner ejector spring section 36 disposed on the ejector rod 27 generally forward of the outer ejector spring section 35 when the ejector means is at its forwardmost position, and ejector spring connector means 37 connecting the forward end of the outer spring section 35 to the rearward end of the inner spring section 36 of the ejector spring. The forward end of the inner ejector spring section 36 abuts against the shoulder 39 of the ejector push rod 27 and the rearward end of the outer ejector spring section 35 abuts against the forwardly facing annular surface 40 of the cylinder 13. As noted above, when the ejector means is moved rearwardly to its cartridge ejecting position, both the inner ejector spring section 36 and the ejector spring connector means 37 are disposed in telescopic fashion within the forward end of the outer ejector spring section 35, thereby increasing the longitudinal travel of the ejector means by an amount corresponding to the length of the telescoped ejector spring sections.

In the advantageous embodiment of the long stroke ejector of the invention shown in FIGS. 2, 3, 6 and 7 the outer ejector spring section 35 and the inner ejector spring section 36 are formed from two separate helically wound wire springs. As noted, the outer ejector spring section (designated **35*a* in FIGS. 6 and 7) is disposed in the annular space between the tubular guide portion 25 of the ejector means and the cylinder pivot shaft 16 of the cylinder crane 12, and the inner ejector spring section (designated 36*a* in FIGS. 6 and 7) is disposed on the ejector rod 27 generally forward of the outer ejector spring section 35*a* when the ejector means is at its forwardmost position. The ejector spring connector means comprises a longitudinally disposed annular connector sleeve (designated 37*a* in FIGS. 6 and 7) having an outwardly extending flange 43 at its forward end and an inwardly extending flange 44 at its rearward end. As shown best in FIGS. 6 and 7, the forward end of the outer ejector spring section 35*a* abuts against the forward flange 43 of the ejector spring connector sleeve 37*a* and the rearward end of the inner ejector spring 36*a* abuts against the rearward flange 44 of the ejector spring connector sleeve. The outside diameter of the annular wall of the ejector spring connector sleeve 37*a* is less than the inside diameter of the outer ejector spring section 35*a*, and the inside diameter of the connector sleeve 37*a* is greater than the outside diameter of the inner ejector spring section 36*a* so that when the ejector means is at its rearwardmost position the connector sleeve 37*a* and the inner ejector spring section 36*a* are received in telescopic fashion within the forward end of the outer ejector spring section 35*a*** in the manner previously described.

Another advantageous embodiment of the long stroke ejector of the invention is shown in FIGS. 4, 5, 8 and 9 wherein the outer ejector spring section 35, the ejector spring connector means 37 and the inner ejector spring section 36 are formed from a continuous length of helically wound wire. As before, the outer ejector spring section (designated **35*b* in FIGS. 8 and 9) is disposed in the annular space between the tubular guide portion 25 of the ejector means and the cylinder pivot shaft 16 of the cylinder crane 12, and the inner ejector spring section (designated 36*b* in FIGS. 8 and 9) is disposed on the ejector rod 27 generally forward of the outer ejector spring section 35*b* when the ejector means is at its forwardmost position. The ejector spring connector means (designated 37*b* in FIGS. 8 and 9) comprises at least one inwardly spiraling turn of the continuous ejector spring that connects the forward end of the outer ejector spring section 35*b* to the rearward end of the inner ejector spring section 36*b*. As shown best in FIG. 8, when the ejector means is at its forwardmost position the inner spring section 36*b* is disposed forwardly of both the inwardly spiraling connector turn 37*b* and the outer ejector spring section 35*b* of the continuous ejector spring. As shown best in FIG. 9, when the ejector means is moved to its rearwardmost position both the inner ejector spring section 36*b* and the inwardly spiraling connector turn 37*b* of the ejector spring are located in telescopic fashion within the forward end of the outer ejector spring section 35*b***.

As noted, the rearward end of the ejector rod 27 is threadably connected to the forward end of the tubular ejector guide portion 25 of the ejector means. In a conventional revolver the ejector rod is usually formed with a rearward facing annular shoulder adjacent the rearward end thereof, and an ejector sring washer is positioned between the said annular shoulder of the ejector rod and the forward end of the tubular ejector guide portion of the ejector means. When the ejector rod is threadably secured to the forward end of the tubular ejector guide portion, the forward end of the ejector spring abuts against the ejector spring washer thereby urging the ejector rod and the ejector means threadably secured thereto to their forwardmost position. The threadably connected ejector rod and ejector means must be firmly tightened to prevent loosening of these parts when the revolver is fired, and to this end a lock washer is sometimes employed between these parts to prevent the loosening thereof. The telescoping ejector spring arrangement of the present invention precludes the use of an ejector spring washer on the rearward end of the ejector rod 27, and in view of the limited space available within the longitudinal center bore 17 of the cylinder pivot shaft 16 it would be extremely difficult to form the rearward end of the ejector rod 27 with an annular shoulder that abuts against the forward end of the tubular ejector guide portion 25 of the ejector means. Accordingly, in order to insure a tight connection between the ejector rod 27 and the tubular guide portion 25 of the ejector means and to prevent loosening of these parts in use, the rearward end of the ejector rod and the forward end of the tubular guide portion are formed with matching male and female tapered sections 46 and 47 the conical surfaces of which frictionally engage each other when these parts are threadably connected together as shown best in FIGS. 6, 7 and 8. The frictional engagement of the tapered sections 46 and 47 of the ejector rod 27 and tubular guide portion 25 prevent inadvertent disengagement of these parts during normal handling and firing of the revolver while nonetheless readily permitting the threadably connected parts to be separated from each other when desired by the user of the firearm.

I claim:

1. In a revolver having a frame, a cylinder crane pivotally mounted on the frame, said cylinder crane having a rearwardly extending cylinder pivot shaft that is formed with a longitudinally extending center bore, a cylinder rotatably mounted on the cylinder pivot shaft of the cylinder crane, said cylinder being formed with a plurality of cartridge receiving chambers, ejector means mounted for longitudinal movement in the longitudinal center bore of the cylinder and cylinder pivot shaft, said ejector means having a cartridge ejector portion for engaging the rims of cartridges contained in the chambers of the cylinder and a generally tubular ejector guide portion slidably mounted on the rearward end of the cylinder and extending forwardly into the longitudinal center bore at the cylinder pivot shaft, said ejector means being movable longitudinally from its forwardmost cartridge receiving position to its rearwardmost cartridge ejection position, an ejector push rod connected to the forward end of the tubular guide portion of the ejector means, the ejector rod being slidably mounted for longitudinal movement on the cylinder crane, and a helically wound ejector spring disposed within the longitudinally extending annular space defined by the outer surface of the tubular guide portion of the ejector means and the inner surface of the longitudinal center bore of the cylinder pivot shaft, said ejector spring urging the ejector means and ejector rod to their forwardmost positions, the improvement which comprises a long stroke ejector having a telescoping ejector spring, said ejector spring having an outer ejector spring section disposed within the annular space defined by the outer surface of the tubular guide portion of the ejector means and the inner surface of the center bore of the cylinder pivot shaft, an inner ejector spring section the outside diameter of which is less then the inside diameter of the outer ejector spring section, said inner ejector spring section being disposed on the rearward end of the ejector rod, and ejector spring connector means connecting the forward end of the outer ejector spring section to the rearward end of the inner ejector spring section, the inner ejector spring section being disposed generally forwardly of the outer ejector spring section when the ejector means is at its forwardmost position and being disposed within the forward end of the outer ejector spring section when the ejector means is at its rearwardmost position.

2. The revolver according to claim 1 in which the rearward end of the ejector rod is threadably connected to the forward end of the tubular ejector guide portion of the ejector means, and in which the rearward end of said ejector rod and the forward end of said tubular ejector guide portion are formed with matching male and female tapered sections which mutually frictionally engage each other when these parts are threadably connected together.

3. The revolver according to claim 1 in which the ejector spring connector means comprises a longitudinally disposed annular connector sleeve having an outwardly extending flange at its forward end and an inwardly extending flange at its rearward end, the forward end of the outer ejector spring section abutting against the forward flange of the ejector spring connector sleeve and the rearward end of the inner ejector spring section abutting against the rearward flange of said connector sleeve, the outside diameter of the annular wall of the ejector spring connector sleeve being less than the inside diameter of the outer ejector spring section and the inside diameter of the annular wall of said connector sleeve being greater than the outside diameter of the inner ejector spring section.

4. The revolver according to claim 3 in which the rearward end of the ejector rod is threadably connected to the forward end of the tubular ejector guide portion of the ejector means, and in which the rearward end of said ejector rod and the forward end of said tubular ejector guide portion are formed with matching male and female tapered sections which mutually frictionally engage each other when these parts are threadably connected together.

5. The revolver according to claim 1 in which the outer ejector spring section and the inner ejector spring section are formed from a continuous length of helically wound wire and in which the ejector spring connector means comprises at least one inwardly spiraling connector turn of the continuous ejector spring, said inwardly spiraling connector turn of the ejector spring being disposed at and connecting the forward end of the outer ejector spring section and the rearward end of the inner ejector spring section.

6. The revolver according to claim 5 in which the rearward end of the ejector rod is threadably connected to the forward end of the tubular ejector guide portion of the ejector means, and in which the rearward end of said ejector rod and the forward end of said tubular ejector guide portion are formed with matching male and female tapered sections which mutually frictionally engage each other when these parts are threadably connected together.

* * * * *